US008457524B2

(12) United States Patent
Cheon et al.

(10) Patent No.: US 8,457,524 B2
(45) Date of Patent: Jun. 4, 2013

(54) DEVELOPING CARTRIDGE, IMAGE FORMING APPARATUS, AND METHOD OF MOUNTING/DEMOUNTING DEVELOPING CARTRIDGE TO/FROM IMAGE FORMING APPARATUS

(75) Inventors: Yong-ju Cheon, Suwon-si (KR); Joo-hwan Noh, Yongin-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 1061 days.

(21) Appl. No.: 12/052,913

(22) Filed: Mar. 21, 2008

(65) Prior Publication Data

US 2009/0087218 A1 Apr. 2, 2009

(30) Foreign Application Priority Data

Sep. 28, 2007 (KR) ..... 10-2007-0098106

(51) Int. Cl.
*G03G 15/00* (2006.01)
*G03G 21/18* (2006.01)
*G03G 15/04* (2006.01)

(52) U.S. Cl.
USPC ..... 399/113; 399/13; 399/119

(58) Field of Classification Search
USPC ..... 399/113
See application file for complete search history.

(56) References Cited

U.S. PATENT DOCUMENTS

| | | | | |
|---|---|---|---|---|
| 7,221,888 | B2 * | 5/2007 | Hymas et al. | 399/111 |
| 2005/0013627 | A1 * | 1/2005 | Jeon | 399/111 |
| 2005/0025522 | A1 * | 2/2005 | Tsuzuki et al. | 399/111 |
| 2006/0193647 | A1 * | 8/2006 | Asakura | 399/13 |
| 2006/0216061 | A1 * | 9/2006 | Yamaguchi | 399/111 |

FOREIGN PATENT DOCUMENTS

CN 1828436 9/2006

OTHER PUBLICATIONS

Office Action issued in Chinese Patent Application No. 200810137726.4 on Aug. 25, 2011.

* cited by examiner

*Primary Examiner* — David Gray
*Assistant Examiner* — Andrew Do
(74) *Attorney, Agent, or Firm* — Stanzione & Kim, LLP

(57) ABSTRACT

A developing unit usable with an image forming apparatus includes a first frame to support a photoconductive medium, a second frame to support a developing member to apply a developer to the photoconductive medium, the second frame movable between a first position in which the photoconductive medium is at a developing gap from the developing member, and a second position in which the photoconductive medium is away from the developing member by a distance exceeding the developing gap, and a positioning unit to move the second frame from a current position in accordance with mounting and demounting of the developing unit to and from the image forming apparatus.

24 Claims, 6 Drawing Sheets

DEVELOPING CARTRIDGE, IMAGE FORMING APPARATUS, AND METHOD OF MOUNTING/DEMOUNTING DEVELOPING CARTRIDGE TO/FROM IMAGE FORMING APPARATUS

CROSS-REFERENCE TO RELATED APPLICATIONS

This application claims priority under 35 U.S.C. §119(a) from Korean Patent Application No. 2007-98106, filed Sep. 28, 2007, in the Korean Intellectual Property Office, the disclosure of which is hereby incorporated in its entirety by reference.

BACKGROUND OF THE INVENTION

1. Field of the Invention

The present general inventive concept relates to an image forming apparatus, and more particularly, to a developing unit removably mounted to an image forming apparatus, and an image forming apparatus having the same.

2. Description of the Related Art

Generally, an image forming apparatus includes a paper feed unit, a developing unit, a transfer unit, a fusing unit, and a paper discharge unit.

Most of the developing units employed in image forming apparatuses for home use are formed as a single body with the developer cartridges, while most of the developing units for office use are separately provided. Because the image forming apparatuses for office use are required to output far more printouts than printouts for home use, maintenance will cost a lot if the image forming apparatuses for office use employ the developing cartridges and the developing units as a set.

While the developer cartridge is replaced frequently, the developing unit, housing therein a photoconductive medium and developing member, is used for a longer period of time. Thus, replacement of the housing unit is less frequent and occurs when the photoconductive medium is too old to react to light exposure, or when image quality degrades severely.

The developing unit is mainly categorized into contact and non-contact types according to the type of developer the developing unit employs therein. FIG. 1 illustrates an example of a non-contact type developing unit.

A photoconductive medium 10 is rotatably disposed on a first frame 1, and a developing roller 20 is disposed on a second frame 1*a* to feed the developer to the photoconductive medium 10. The second frame 1*a* is capable of pivoting about the first frame 1.

The developing roller 20 necessarily keeps a predetermined developing distance from the photoconductive medium 10 so that an image can be formed with proper density. Accordingly, developing gap maintaining discs 30 are disposed on both ends of a developing roller shaft 21. The developing roller shaft 21 rotatably supports the developing roller 20.

The developing gap maintaining discs 30 are rotatable in association with the rotation of the developing roller 20 and the developing roller shaft 21. The developing gap maintaining discs 30 are made by plastic molding, and are disposed to rotate in contact with the non-image area.

However, problems occur when the photoconductive medium 10 is maintained in contact with the developing gap maintaining discs 30. First, an unexpected impact may be exerted to the developing unit when the developing unit is moved or operated, subsequently causing physical damage to the developing gap maintaining discs 30. Subsequently, the damaged developing gap maintaining discs 30 do not maintain the desired developing gaps, and as a result, image quality degradations such as creasing occur. In order to avoid this problem, keeping the photoconductive medium 10 and the developing gap maintaining discs 30 at distance when the developing unit is not mounted to the image forming apparatus is necessary.

FIG. 2 illustrates an example in which the second frame 1*a* is temporarily fixed in place to keep the photoconductive medium 10 at a distance from the developing gap maintaining discs 30 to prevent unwanted damages to the developing gap maintaining discs 30.

Most of the rotating components such as the developing roller 20 and feeding roller 25 are fixed to the second frame 1*a* housed in the developing unit, and the second frame 1*a* is hinged to the first frame 1 to turnably move between a first position and a second position. The second frame 1*a* is in a first position when the developing unit is mounted to the image forming apparatus and the photoconductive medium 10 contacts the developing gap maintaining discs 30, and moved to a second position when the developing unit is demounted from the image forming apparatus and the photoconductive medium 10 is separated apart from the developing gap maintaining discs 30.

Accordingly, a separate fixing member is required to fix the second frame 1*a* in the second position. Generally, a rubber pin 1*b* is passed through the developing unit from outside to prevent rotation of the second frame 1*a*.

However, most of the printer users are not familiar with detailed structure of the components. When a unknowledgeable user tries to replace the developing unit, the user likely puts the developing unit in the image forming apparatus without knowing that the rubber pin 1*b* should be removed beforehand. In this case, because the developing gap maintaining discs 30 do not contact the photoconductive medium 10, the proper developing gap is not maintained during the operation of the image forming apparatus and image error occurs.

Furthermore, a requirement for the removal of the rubber pin 1*b* before mounting the developing unit is inconvenient for the user.

SUMMARY OF THE INVENTION

The present general inventive concept provides a developing unit with improved structure to release a safety device to prevent damages to inner components thereof upon mounting the developing unit to an image forming apparatus, and an image forming apparatus having the same.

The present general inventive concept also provides a developing unit with improved structure to switch on or off components such as an optical scanning device that are potentially dangerous to users upon mounting to an image forming apparatus, and an image forming apparatus having the same.

Additional aspects and utilities of the present general inventive concept will be set forth in part in the description which follows and, in part, will be obvious from the description, or may be learned by practice of the general inventive concept.

The foregoing and/or other aspects and utilities of the present general inventive concept may be achieved by providing a developing unit usable with an image forming apparatus. The developing unit includes a first frame to support a photoconductive medium, a second frame to support a developing member to apply a developer to the photoconductive medium, the second frame movable between a first position in which the photoconductive medium is at a developing gap from the developing member, and a second position in which the photoconductive medium is away from the developing member by a distance exceeding the developing gap, and a positioning unit to move the second frame from a current position in accordance with mounting and demounting of the developing unit to and from the image forming apparatus.

The second frame may be hinged to the first frame and moved to the first position by a weight of the second frame.

Developing gap maintaining members may be provided on both sides of the developing member to maintain the developing gap by contact with the photoconductive medium.

The positioning unit may include a lever member reciprocatingly movable on the first frame, and having at least one first protrusion formed thereon, and a second protrusion formed on the second frame to selectively contact the first protrusion according to a movement of the lever member.

The first frame may include a guide rail formed thereon to guide the movement of the lever member.

The guide rail may include a restriction groove to control the movement of the lever member, and the lever member may include a restriction protrusion placed within the restriction groove.

The developing unit may further include an elastic member disposed between the restriction groove and the restriction protrusion to return the lever member to an initial position.

The first and second protrusions may each include inclined surfaces to correspond to each other.

The present general inventive concept, the lever member may include an interference portion to be interfered with the image forming apparatus when the developing unit is mounted to the image forming apparatus.

The interference portion may operate to switch on a safety switch of an optical scanning device which is provided in the image forming apparatus, when the developing unit is mounted to the image forming apparatus.

The foregoing and/or other aspects and utilities of the present general inventive concept may also be achieved by providing a developing unit usable with an image forming apparatus. The developing unit includes a first frame including a photoconductive medium rotatably disposed thereon, a second frame pivotally connected to the first frame, and including a developing member, a feeding member and developing gap maintaining members formed thereon, wherein the developing gap maintaining members are formed on a rotating shaft of the developing member, and a positioning unit complementarily formed between the first and second frames, and if the developing unit is mounted to the image forming apparatus, to rotate the second frame to a position in which the photoconductive medium contacts the developing gap maintaining members, and if the developing unit is demounted from the image forming apparatus, to rotate the second frame to a position in which the photoconductive medium is separated from the developing gap maintaining members.

The positioning unit may include a guide rail formed on the first frame to face a bottom of the second frame, a lever member reciprocatingly movable along the guide rail, and including two first protrusions, and two second protrusions formed on the second frame to face the first protrusion, to selectively contact the first protrusions according to the reciprocating movement of the lever member. The first protrusions press the second protrusions when the developing unit is not mounted to the image forming apparatus to fix the second frame in a position in which the photoconductive medium is separated from the developing gap maintaining members. The first and the second protrusions are released from contact with each other when the developing unit is mounted to the image forming apparatus to cause the second frame to turn by a weight of the second frame to a position in which the photoconductive medium contacts the developing gap maintaining members.

The first and second protrusions may include inclining surfaces to correspond to each other.

The guide rail may include a restriction groove to control a movement of the lever member, and the lever member may include a restriction protrusion placed within the restriction groove.

The foregoing and/or other aspects and utilities of the present general inventive concept may also be achieved by providing a developing unit usable with an image forming apparatus. The developing unit includes a photoconductive medium, a developing member to supply a developer to the photoconductive medium, and a positioning unit to vary a distance between the photoconductive medium and the developing member. The developing unit is mounted to the image forming apparatus in a first direction, and the positioning unit varies the distance between the photoconductive medium and the developing member in a second direction different from the first direction.

The first direction may correspond to a length direction of the photoconductive medium, and the second direction corresponds to a distance between shafts of the photoconductive medium and the developing member.

The foregoing and/or other aspects and utilities of the present general inventive concept may also be achieved by providing an image forming apparatus. The image forming apparatus includes a main body housing therein an optical scanning device to scan a photoconductive medium, a printing medium feeding unit, a transfer unit, a fusing unit, a printing medium discharge unit, and a developing unit to be removably mounted to the image forming apparatus to form an image. The developing unit includes a first frame including a photoconductive medium rotatably disposed thereon, a second frame pivotally connected to the first frame, and including a developing member, a feeding member and developing gap maintaining members formed thereon, wherein the developing gap maintaining members are formed on a rotating shaft of the developing member, and a positioning unit complementarily formed between the first and second frames, and if the developing unit is mounted to the image forming apparatus, to rotate the second frame to a position in which the photoconductive medium contacts the developing gap maintaining members, and if the developing unit is demounted from the image forming apparatus, to rotate the second frame to a position in which the photoconductive medium is separated from the developing gap maintaining members.

The positioning unit may include a guide rail formed on the first frame to face a bottom of the second frame, a lever member reciprocatingly movable along the guide rail, and including two first protrusions, and two second protrusions formed on the second frame to face the first protrusion, to selectively contact the first protrusions according to the reciprocating movement of the lever member. The first protrusions press the second protrusions when the developing unit is not mounted to the image forming apparatus to fix the second frame in a position in which the photoconductive medium is separated from the developing gap maintaining members. The first and the second protrusions are released from contact with each other when the developing unit is mounted to the image forming apparatus to cause the second frame to turn by a weight of the second frame to a position in which the photoconductive medium contacts the developing gap maintaining members.

The first and second protrusions may include inclining surfaces to correspond to each other.

The guide rail may include a restriction groove to control a movement of the lever member, the lever member including a restriction protrusion placed within the restriction groove, and an elastic member is disposed between the restriction groove and the restriction protrusion.

The developing unit may be mounted to the main body of the image forming apparatus in a first direction, and the positioning unit varies a distance between the photoconductive medium and the developing member in a second direction different from the first direction.

The first direction may correspond to a length of the photoconductive medium, and the second direction is approximately perpendicular to the first direction.

A user does not have to remove a safety device to form a developing gap, because a developing gap is automatically created between a photoconductive medium and a developing member in accordance with mounting of the developing unit to an image forming apparatus.

Furthermore, product safety is enhanced because power supplied to an optical scanning device is automatically blocked in accordance with demounting of a developing unit. Thus, a user is protected even if the optical scanning device malfunctions.

The foregoing and/or other aspects and utilities of the general inventive concept may also be achieved by providing a developing unit having a mounting state and a demounting state usable with an image forming apparatus, the developing unit including a plurality of frames movable with respect to each other between in a first position and a second position, and including one frame to support a photoconductive medium and an other frame to support a developing member, and a positioning unit to move at least one of the plurality of frames between the first position and the second position based on the respective state of the developing unit, wherein spacing between the photosensitive medium and the developing member is greater in the second position than the first position.

The developing unit may further include an interference portion to engage a safety switch of the image forming apparatus based on a position of the positioning unit to prevent a user from receiving unwanted radiation.

The foregoing and/or other aspects and utilities of the general inventive concept may also be achieved by providing a method of changing a developing unit of an image forming apparatus, the method including moving at least one of a plurality of frames respectively supporting a photoconductive medium and a developing member of a developing unit with respect to each other between a first position and a second position based on one of a mounting state and a demounting state of the developing unit, and engaging a safety switch to prevent a user from receiving unwanted radiation based on whether the plurality of frames are in the first position or the second position.

BRIEF DESCRIPTION OF THE DRAWINGS

These and/or other aspects and utilities of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
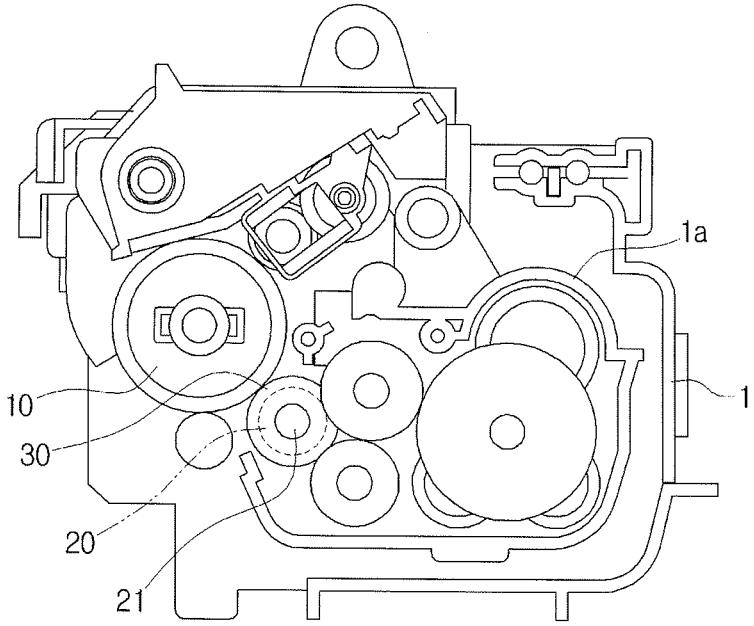
FIG. 1 (PRIOR ART)
FIGS. 1 and 2 are cross section views illustrating a conventional developing unit of an image forming apparatus.
Figure 2:
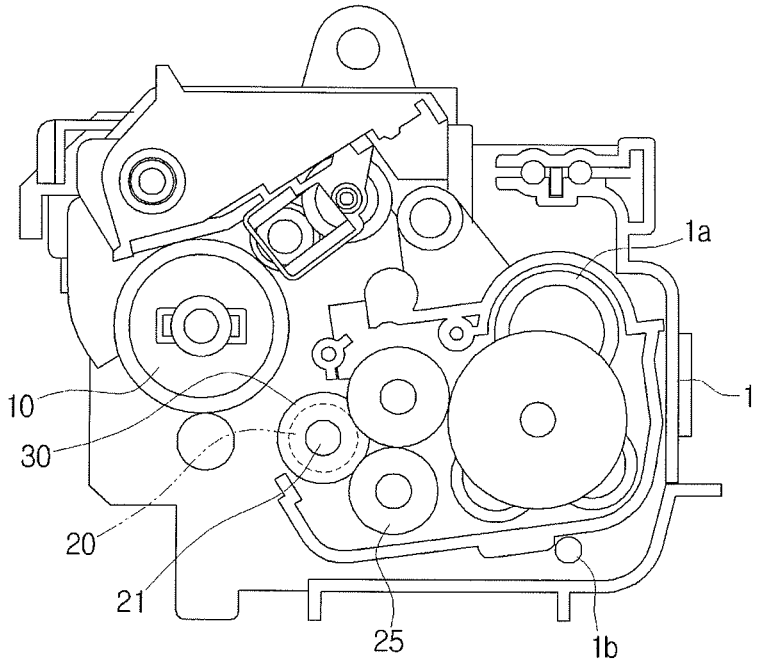
FIG. 2 (PRIOR ART)

Reference will now be made in detail to embodiments of the present general inventive concept, examples of which are illustrated in the accompanying drawings, wherein like reference numerals refer to the like elements throughout. The embodiments are described below in order to explain the present general inventive concept by referring to the figures.

Figure 3:
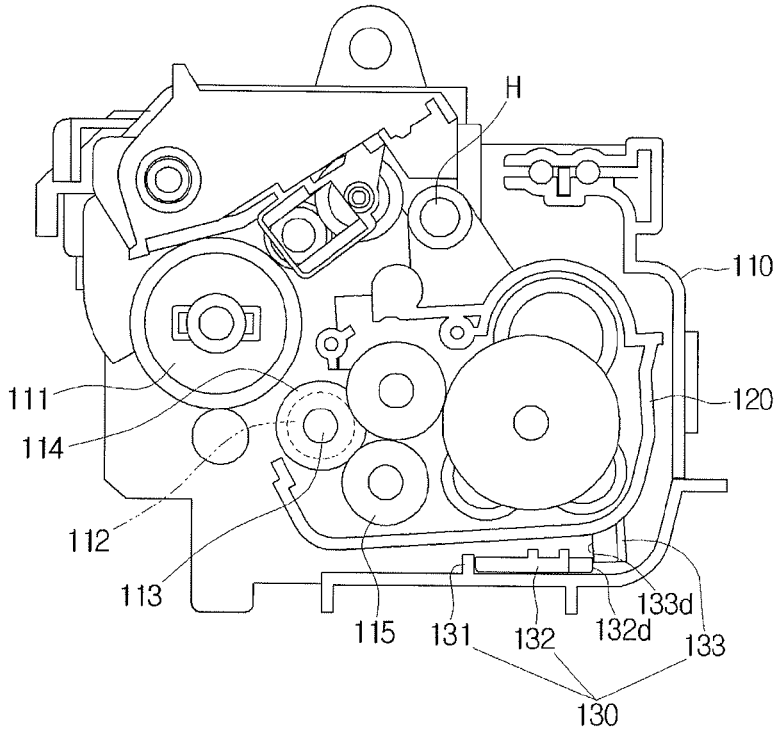
FIG. 3 is a cross section view illustrating a developing unit before mounting to a main body of an image forming apparatus according to an exemplary embodiment of the present general inventive concept.
Figure 4:
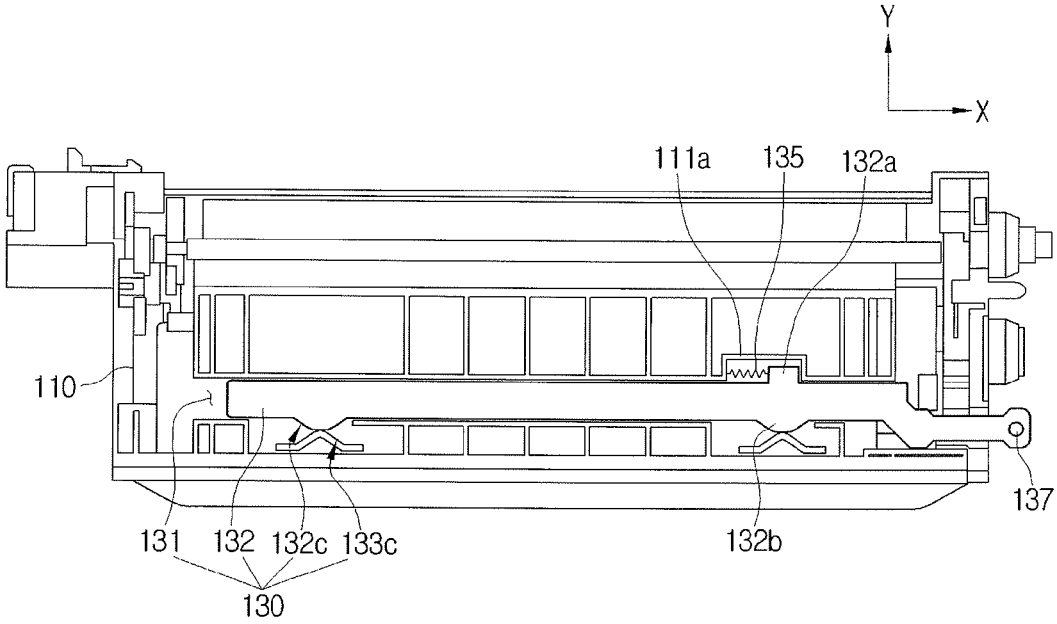
FIG. 4 is a bottom view illustrating the developing unit of FIG. 3.

FIGS. 3 and 4 illustrate a developing unit before mounting to an image forming apparatus according to an exemplary embodiment of the present general inventive concept.

Referring to FIGS. 3 and 4, the developing unit includes a first frame 110, a second frame 120 turnable about a hinge point H of the first frame 110, and a positioning unit 130 to change a position of the second frame 120.

The first frame includes a photoconductive medium 111 rotatably disposed thereon, and the second frame 120 includes a developing member 112 and a feeding member 115 disposed thereon to supply the developer to the photoconductive medium 111. The second frame 120 is movable between the first position where the photoconductive medium 111 and the developing member 112 stay at a predetermined distance from each other, and the second position where the photoconductive medium 111 and the developing member 120 are spaced apart from each other wider than at the first position.

That is, the photoconductive medium 111 and the developing member 112 are arranged at a distance from each other to allow optimum jumping of the non-contact type developer. The photoconductive medium 111 and the developing member 112 may be implemented as roller members. Disc type developing gap maintaining members 114 (hereinafter, developing gap maintaining discs) are disposed on a rotating shaft 113 of the developing member 112 to maintain a predetermined developing gap from the photoconductive medium 111. The developing gap maintaining discs 114 may be disposed on both ends of the rotating shaft 113 to contact a non-image area of the photoconductive medium 111. The developing gap maintaining discs 114 may each have a radius (R) to satisfy $R-r=d$, where 'r' is the radius of the developing member 112 and 'd' is the developing gap.

The positioning unit 130 is complimentarily disposed between the first and second frames 110 and 120 to fix the second frame 120 to the second position when the developing unit is not mounted to the image forming apparatus, and to rotate the second frame 120 toward the first position upon mounting of the developing unit to the image forming apparatus.

According to an exemplary embodiment of the present general inventive concept, the positioning unit 130 includes a guide rail 131, a lever member 132 and a second protrusion 133.

The guide rail 131 is formed on the first frame 110 to guide the movement of the lever member 132 so that the lever member 132 reciprocates exclusively in a width direction (that is, in X direction in FIG. 4) of the first frame 110. Therefore, the lever member 132 is prevented from moving in a length direction (that is, in Y direction in FIG. 4) of the first frame 110 due to the guide rail 131.

Figure 5:
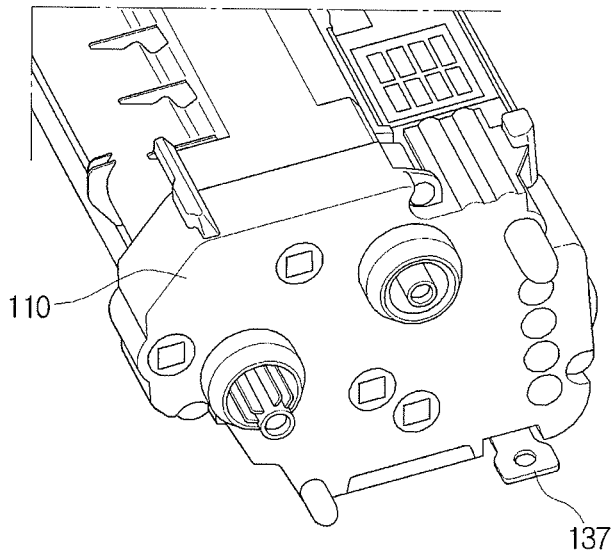
FIG. 5 is a perspective view illustrating the developing unit of FIG. 3.
Figure 9:
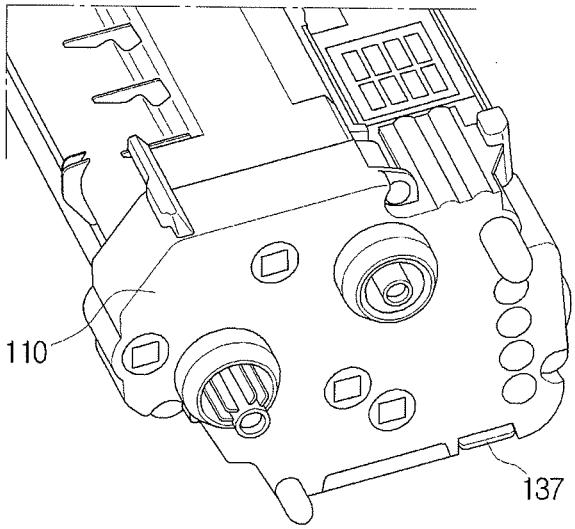
FIG. 9 is a perspective view illustrating the developing unit of FIG. 6.

The lever member 132 includes an interference portion 137 (FIG. 4) formed thereon. Referring to FIG. 5, the interference portion 137 protrudes out of the developing unit when the developing unit is not mounted to the image forming apparatus, and retreats into the developing unit as the developing unit is mounted to the body of the image forming apparatus (FIG. 9).

When the first frame 110 is mounted to the image forming apparatus, the interference portion 137 interferes with inner walls or components of the image forming apparatus to cause the lever member 132 to move along the guide rail 131.

While the developing unit is mounted, the interference portion 137 may operate to switch on or off some components. For example, the interference portion 137 may be moved according to the mounting and demounting of the developing unit to switch a safety switch S (FIG. 10) of a optical scanning device of the image forming apparatus and to protect a user's eyes from hazardous laser beams. Accordingly, a user safety increases because power to the optical scanning device is cut off automatically by the interference portion 137 which turns off the safety switch S by releasing the contact when the developing unit is demounted to expose the optical scanning device to the outside.

The first frame 110 includes a restriction groove 111*a*, and the lever member 132 includes a restriction protrusion 132*a* to be seated on the restriction groove 111*a*. The restriction protrusion 132*a* is movable along the restriction groove 111*a* to cause the lever member 132 to move a distance corresponding to a width of the restriction groove 111*a*. An elastic member 135 may desirably be disposed between the restriction groove 111*a* and the restriction protrusion 132*a* to keep the interference portion 137 outside the developing unit unless the interference portion 137 is interfered by the other components. However, the elastic member 135 is only an example of the present embodiment. For example, the elastic member 135 may be omitted if the lever member 132 is required to move only once during the mounting of developing unit.

Figure 8:
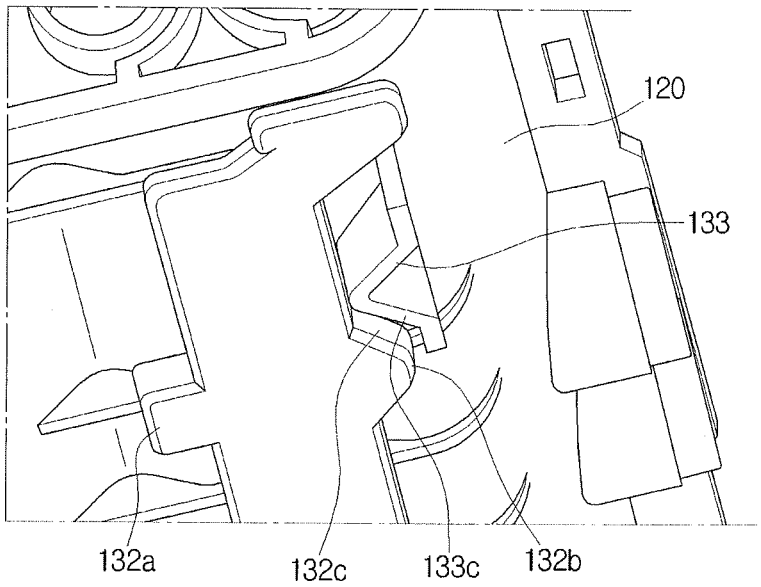
FIG. 8 is a bottom perspective view illustrating the developing unit of FIG. 6.

The lever member 132 includes at least one first protrusion 132*b*, and the second frame 120 (FIG. 3) includes a second protrusion 133 formed to face the first protrusion 132*b*. A pair of first protrusions 132*b* may be formed approximately at both ends of the first frame 110. The first and second protrusions 132*b* and 133 may include inclining surfaces 132*c* and 133*c* (FIGS. 4 and 8) formed on contacting surfaces to minimize the friction caused while the lever member 132 is reciprocated.

The operation of the developing unit according to exemplary embodiments of the present general inventive concept will be explained below.

Referring to FIGS. 3 and 4, the developing unit is not yet mounted to the main body of the image forming apparatus. In this state, the ends 132*d* and 133*d* of the first and second protrusions 132*b* and 133 are supported on each other by contact, to temporarily fix the second frame 120 in the second position.

Because the photoconductive medium 111 of the first frame 110 is kept at a distance from the developing gap maintaining discs 114 of the second frame 120 in this state, the breakage or deformation of the developing gap maintaining discs 114 due to external shock that may be exerted as the user carries the developing unit, is prevented.

As the ends 132*d* and 133*d* of the first and second protrusions 132*b* and 133 are contacted with each other, as illustrated in FIG. 5, the interference portion 137 of the lever member 132 protrudes outside the developing unit. The protruding lever member 132 may interfere with inner components of the developing unit mount portion of the image forming apparatus while the developing unit is mounted to the main body of the image forming apparatus.

If the developing unit is mounted to the image forming apparatus in the length direction of the photoconductive medium 111 (that is, in the first direction), the positioning unit 130 moves in a second direction that is perpendicular to the first direction and that connects the shafts of the photoconductive medium 111 and the developing member 112 to create a developing gap between the photoconductive medium 111 and the developing member 112. The interference portion 137, protruding in this state, is interfered by the safety switch S of the optical scanning device formed inside the image forming apparatus, and thus retreated inward of the developing unit. Referring to FIG. 7, the lever member 132 moves in an arrowed direction A, and the end 133*d* of the second protrusion 133 is separated from the end 132*d* of the first protrusion 132*b*. Accordingly, the second frame 120 (FIG. 8) rotates about the hinge point H (FIG. 6) until the end 132*d* of the first protrusion 132*b* contacts the side 132*e* of the lever member 132.

Figure 6:
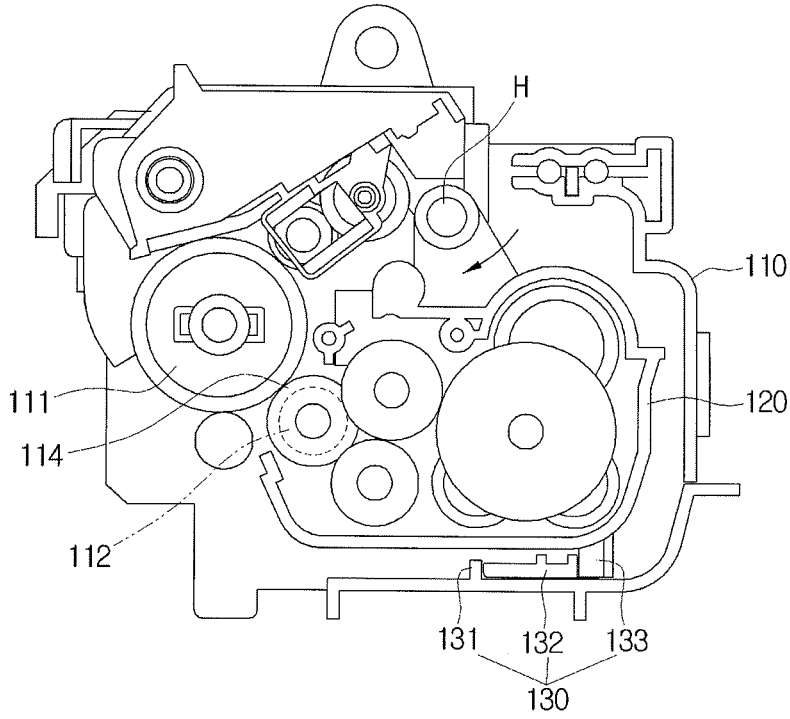
FIG. 6 is a cross section view illustrating a developing unit being mounted to a main body of an image forming apparatus according to an exemplary embodiment of the present general inventive concept.
Figure 7:
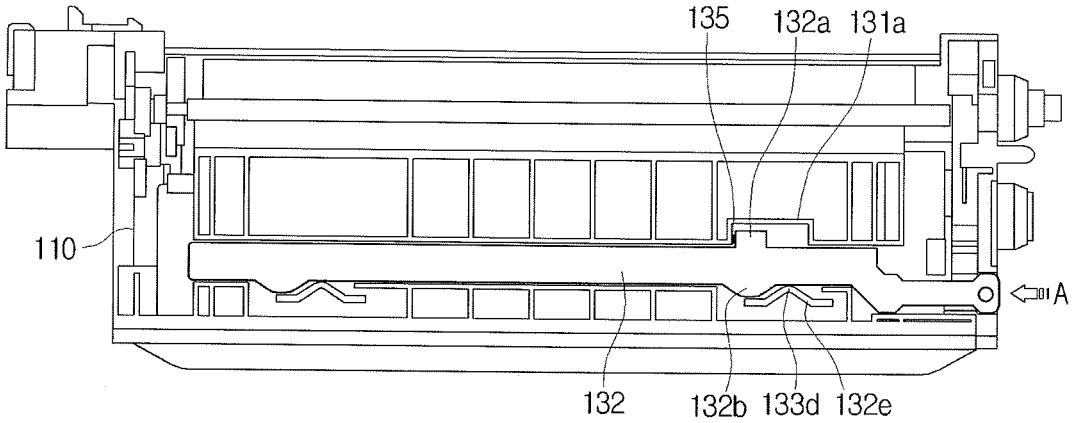
FIG. 7 is a bottom view illustrating the developing unit of FIG. 6.

Referring to FIGS. 6 and 7, when the end 132*d* of the first protrusion 132*b* contacts the side 132*e* of the lever member 132, the photoconductive medium 111 and the developing gap maintaining discs 114 contact each other in a non-image forming area of the photoconductive medium 111, to maintain a predetermined developing gap between the developing member 112 and the photoconductive medium 111.

If necessary, an elastic member such as a torsion spring may be disposed on the hinge point H for the second frame 120 to rotate efficiently. However, because the second frame 120 supports a plurality of components such as the developing member 112 and feeding member 113, the second frame 120 may smoothly turn by a weight of the second frame.

Figure 10:
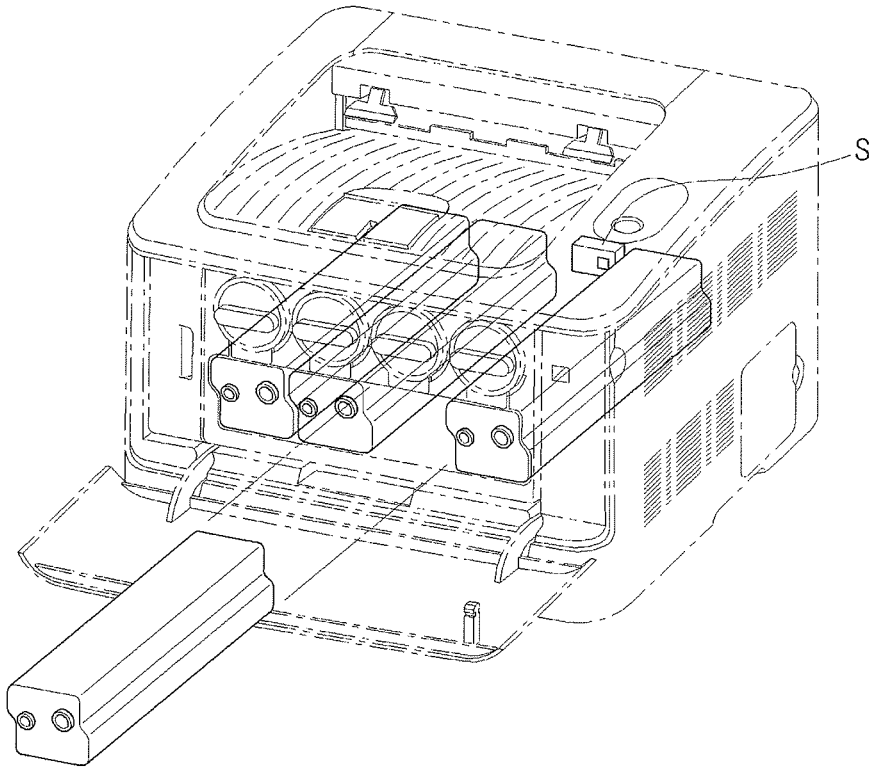
FIG. 10 is a perspective view illustrating an image forming apparatus according to an exemplary embodiment of the present general inventive concept.

Referring to FIG. 10, when the developing unit is mounted to the mounting portion of the image forming apparatus, the interference portion 137 may switch on the safety switch S to connect the power supplied to the optical scanning device. Accordingly, the optical scanning device operates only when the developing unit is in a correct position.

As explained above, the second frame 120 is moved in accordance with the mounting and demounting of the developing unit. Accordingly, using a separate and usually expensive fixing component to fix the second frame 120 in a respective position thereof, and removing all the fixed components to mount the developing unit is not necessary.

Figure 11:
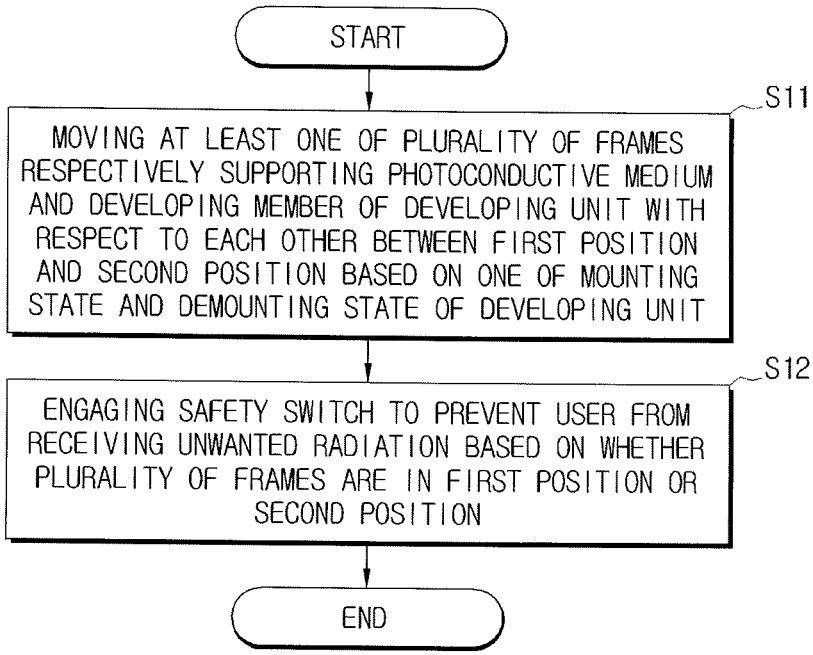
FIG. 11 is a flowchart illustrating a method of changing a developing unit of an image forming apparatus in an exemplary embodiment of the present general inventive concept.

FIG. 11 is a flowchart illustrating a method of changing a developing unit of an image forming apparatus in an exemplary embodiment of the present general inventive concept. Referring to FIGS. 6, 10 and 11, in operation S11, at least one of a plurality of frames 110 and 120 respectively supporting a photoconductive medium 111 and a developing member 112 of a developing unit is moved with respect to each other between a first position and a second position based on one of a mounting state and a demounting state of the developing unit with respect to the image forming apparatus. In operation S12, a safety switch S is engaged to prevent a user from receiving unwanted radiation based on whether the plurality of frames 110 and 120 are in the first position or the second position.

Furthermore, because potentially dangerous components are switched in accordance with the mounting and demounting of the developing unit, safety of the product is increased.

Although various embodiments of the present general inventive concept have been illustrated and described, it will be appreciated by those skilled in the art that changes may be made in these embodiments without departing from the principles and spirit of the general inventive concept, the scope of which is defined in the appended claims and their equivalents. As used in this disclosure, the term "preferably" is non-exclusive and refers to "preferably, but not limited to." Terms in the claims should be given their broadest interpretation consistent with the general inventive concept as set forth in this description. For example, the terms "coupled" and "connect" (and derivations thereof) are used to connote both direct and indirect connections/couplings. As another example, "having" and "including", derivatives thereof and similar transition terms or phrases are used synonymously with "comprising" (i.e., all are considered "open ended" terms)—only the phrases "consisting of" and "consisting essentially of" should be considered as "close ended". Claims are not intended to be interpreted under 112 sixth paragraph unless the phrase "means for" and an associated function appear in a claim and the claim fails to recite sufficient structure to perform such function.

What is claimed is:

1. A developing unit usable with an image forming apparatus, the developing unit comprising:

a first frame to support a photoconductive medium;

a second frame to support a developing member to apply a developer to the photoconductive medium, the second frame movable between a first position in which the photoconductive medium is at a developing gap from the developing member, and a second position in which the photoconductive medium is away from the developing member by a distance exceeding the developing gap; and a positioning unit to move the second frame from a current position in accordance with mounting and demounting of the developing unit to and from the image forming apparatus wherein the positioning unit comprises:

a reciprocatingly movable member disposed within at least a portion of the first frame, and having at least one first protrusion formed thereon; and a second protrusion formed on the second frame to selectively contact the first protrusion according to a reciprocating movement of the reciprocatingly movable member.

2. The developing unit of claim 1, wherein the second frame is hinged to the first frame and moved to the first position by a weight of the second frame.

3. The developing unit of claim 1, wherein developing gap maintaining members are provided on both sides of the developing member to maintain the developing gap by contact with the photoconductive medium.

4. The developing unit of claim 1, wherein the first frame comprises:

a guide rail formed thereon to guide the movement of the reciprocatingly movable member.

5. The developing unit of claim 4, wherein the guide rail comprises a restriction groove to control the movement of the reciprocatingly movable member, and the reciprocatingly movable member comprises a restriction protrusion placed within the restriction groove.

6. The developing unit of claim 5, further comprising:

an elastic member disposed between the restriction groove and the restriction protrusion to return the reciprocatingly movable member to an initial position.

7. The developing unit of claim 1, wherein the first and second protrusions each comprise:

inclined surfaces to correspond to each other.

8. The developing unit of claim 1, wherein the reciprocatingly movable member comprises:

an interference portion to interfere with a portion of the image forming apparatus when the developing unit is mounted to the image forming apparatus.

9. The developing unit of claim 8, wherein the interference portion operates to switch on a safety switch of an optical scanning device which is provided in the image forming apparatus, when the developing unit is mounted to the image forming apparatus.

10. A developing unit usable with an image forming apparatus, the developing unit comprising:

a first frame including a photoconductive medium rotatably disposed thereon;

a second frame pivotally connected to the first frame inside the first frame, and including a developing member, a feeding member and developing gap maintaining members formed thereon, wherein the developing gap maintaining members are formed on a rotating shaft of the developing member; and a positioning unit complementarily formed between the first and second frames inside the first frame, and if the developing unit is mounted to the image forming apparatus to rotate the second frame to a position in which the photoconductive medium contacts the developing gap maintaining members, and if the developing unit is demounted from the image forming apparatus to rotate the second frame to a position in which the photoconductive medium is separated from the developing gap maintaining members, wherein the positioning unit comprises:

a guide rail formed on the first frame to face a bottom of the second frame;

a reciprocatingly movable member along the guide rail, and including two first protrusions; and two second protrusions formed on the second frame to face the first protrusion, to selectively contact the first protrusions according to the reciprocating movement of the reciprocatingly movable member.

11. The developing unit of claim 10, wherein the first protrusions press the second protrusions when the developing unit is not mounted to the image forming apparatus to fix the second frame in a position in which the photoconductive medium is separated from the developing gap maintaining members, and the first and the second protrusions are released from contact with each other when the developing unit is mounted to the image forming apparatus to cause the second frame to turn by a weight of the second frame to a position in which the photoconductive medium contacts the developing gap maintaining members.

12. The developing unit of claim 11, wherein the first and second protrusions comprise:

inclining surfaces to correspond to each other.

13. The developing unit of claim 12, wherein the guide rail comprises a restriction groove to control a movement of the reciprocatingly movable member, and the reciprocatingly movable member comprises a restriction protrusion placed within the restriction groove.

14. A developing unit usable with an image forming apparatus, the developing unit comprising:

a first frame including a photoconductive medium;

a second frame including a developing member to supply a developer to the photoconductive medium; and a positioning unit to vary a distance between the photoconductive medium and the developing member by moving the second frame with respect to the first frame, wherein the developing unit is mounted to the image forming apparatus in a first direction, and the positioning unit varies the distance between the photoconductive medium and the developing member in a second direction different from the first direction, wherein the positioning unit comprises:

a reciprocatingly movable member disposed within at least a portion of the first frame, and having at least one first protrusion formed thereon; and a second protrusion formed on the second frame to selectively contact the first protrusion according to a reciprocating movement of the reciprocatingly movable member.

15. The developing unit of claim 14, wherein the first direction corresponds to a length direction of the photoconductive medium, and the second direction corresponds to a line connecting shafts of the photoconductive medium and the developing member.

16. An image forming apparatus, comprising:

a main body housing therein an optical scanning device to scan a photoconductive medium, a printing medium feeding unit, a transfer unit, a fusing unit, and a printing medium discharge unit; and a developing unit to be removably mounted to the image forming apparatus to form an image, wherein the developing unit comprises:

a first frame including a photoconductive medium rotatably disposed thereon, a second frame pivotally connected to the first frame inside the first frame, and including a developing member, a feeding member and developing gap maintaining members formed thereon, wherein the developing gap maintaining members are formed on a rotating shaft of the developing member, and a positioning unit complementarily formed between the first and second frames inside the first frame, and if the developing unit is mounted to the image forming apparatus, to rotate the second frame to a position in which the photoconductive medium contacts the developing gap maintaining members, and if the developing unit is demounted from the image forming apparatus, to rotate the second frame to a position in which the photoconductive medium is separated from the developing gap maintaining members, wherein the positioning unit comprises:

a guide rail formed on the first frame to face a bottom of the second frame;

a reciprocatingly movable member along the guide rail, and including two first protrusions; and two second protrusions formed on the second frame to face the first protrusion, to selectively contact the first protrusions according to the reciprocating movement of the reciprocatingly movable member.

17. The image forming apparatus of claim 16, wherein the first protrusions press the second protrusions when the developing unit is not mounted to the image forming apparatus to fix the second frame in a position in which the photoconductive medium is separated from the developing gap maintaining members, and the first and the second protrusions are released from contact with each other when the developing unit is mounted to the image forming apparatus to cause the second frame to turn by a weight of a second frame to a position in which the photoconductive medium contacts the developing gap maintaining members.

18. The image forming apparatus of claim 17, wherein the first and second protrusions comprise:

inclining surfaces to correspond to each other.

19. The image forming apparatus of claim 18, wherein the guide rail comprises a restriction groove to control the movement of the reciprocatingly movable member, the reciprocatingly movable member comprises a restriction protrusion placed within the restriction groove, and an elastic member is disposed between the restriction groove and the restriction protrusion.

20. The image forming apparatus of claim 16, wherein the developing unit is mounted to the main body of the image forming apparatus in a first direction, and the positioning unit varies a distance between the photoconductive medium and the developing member in a second direction different from the first direction.

21. The image forming apparatus of claim 20, wherein the first direction corresponds to a length of the photoconductive medium, and the second direction is approximately perpendicular to the first direction.

22. A developing unit having a mounting state and a demounting state usable with an image forming apparatus, the developing unit comprising:

a plurality of frames movable with respect to each other between in a first position and a second position, and including one frame to support a photoconductive medium and another frame to support a developing member; and a positioning unit to move the another frame between the first position and the second position based on the respective state of the developing unit, wherein spacing between the photosensitive medium and the developing member is greater in the second position than the first position, wherein the positioning unit comprises:

a reciprocatingly movable member disposed within at least a portion of the one frame, and having at least one first protrusion formed thereon; and a second protrusion formed on the another frame to selectively contact the first protrusion according to a reciprocating movement of the reciprocatingly movable member.

23. The developing unit of claim 22, further comprising:

an interference portion to engage a safety switch of the image forming apparatus based on a position of the positioning unit to prevent a user from receiving unwanted radiation.

24. A method of changing a developing unit of an image forming apparatus, the method comprising:

moving at least one of a plurality of frames respectively supporting a photoconductive medium and a developing member of a developing unit with respect to each other between a first position corresponding to a mounting state of the developing unit and a second position corresponding to demounting state of the developing unit; and engaging a safety switch to prevent a user from receiving unwanted radiation based on whether the plurality of frames are in the first position or the second position wherein the positioning unit comprises:

a reciprocatingly movable member disposed within at least a portion of the at least one frame of the plurality of frames, and having at least one first protrusion formed thereon; and a second protrusion formed on another frame of the plurality of frames to selectively contact the first protrusion according to a reciprocating movement of the reciprocatingly movable member.

* * * * *